United States Patent [19]

Aiga et al.

[11] Patent Number: 4,720,659

[45] Date of Patent: Jan. 19, 1988

[54] MAGNETRON

[75] Inventors: Masayuki Aiga; Tetsuji Hashiguchi, both of Hyogo, Japan

[73] Assignee: Sanyo Electric Co., Ltd., Japan

[21] Appl. No.: 856,956

[22] Filed: Apr. 28, 1986

[30] Foreign Application Priority Data

May 2, 1985 [JP] Japan ..... 60-95132

[51] Int. Cl.[4] ..... H01J 23/22

[52] U.S. Cl. ..... 315/39.69; 315/39.51; 315/39.75

[58] Field of Search ..... 315/39.51, 39.53, 39.75, 315/39.69, 39

[56] References Cited

U.S. PATENT DOCUMENTS 3,176,188 3/1965 Wilbur ..... 315/39.69

4,300,072 11/1981 Tashiro ..... 315/39.51

*Primary Examiner*—Leo H. Boudreau

*Assistant Examiner*—Mark R. Powell

*Attorney, Agent, or Firm*—Darby & Darby

[57] ABSTRACT

In an interaction space (7) defined between a cathode (2) and forward ends of vanes (3), an even direct-current magnetic field is applied by magnets (8) along the axial direction of the cathode (2). Direct-current or low-frequency high voltage is applied between the cathode (2) and the respective vanes (3). Spaces (6) surrounded by respective two adjacent vanes (3) and the inner wall of the anode cylinder (4) define cavity resonators, which generate high-frequency electric fields concentrated to the forward end portions of the respective vanes (3) and partially leaking in the interaction space (7). Under such conditions, an electron group emitted from the cathode (2) rotates about the cathode (2) in the interaction space, whereby interaction takes place between the electron group and the high-frequency electric fields to oscillate microwaves. At this time, undesired higher harmonics generated with the microwaves of basic frequency are suppressed by arranging inner strap rings (5*a*) in positions separated from the forward ends of the vanes (3) to exceed a prescribed interval.

12 Claims, 4 Drawing Figures

MAGNETRON

BACKGROUND OF THE INVENTION

1. Field of the Invention

The present invention relates to a magnetron, and more particularly, it relates to a magnetron provided with improved strap rings.

2. Description of the Prior Art

FIG. 1A is a partially fragmented front elevational view showing structure of a conventional magnetron disclosed in, e.g., Japanese Utility Model Publication Gazette No. 55562/1983. FIG. 1B is a sectional view taken along the line X—X in FIG. 1A. FIG. 1C is a sectional view taken along the line Y—Y in FIG. 1B. Referring to these drawings, a magnetron 1 is provided in its center with a cathode 2, which has a filament in the interior thereof for generating electrons. A plurality of panel-shaped vanes 3 are radially arranged to surround the cathode 2. The outer end portions of these vanes 3 are fixed to the inner wall of an anode cylinder 4 or integrally formed with the same. Two inner strap rings 5*a*, which are selected to be identical in diameter, are provided on upper and lower ends (in FIGS. 1A and 1C) of the vanes 3. The inner strap rings 5*a* are arranged in positions in the distance ratio of 13% from the forward end portions of the vanes 3 with respect to the full length L thereof. Further provided on the upper and lower ends of the vanes 3 are two outer strap rings 5*b*, which are larger than the inner strap rings 5*a* and selected to be identical in diameter. These inner and outer strap rings 5*a* and 5*b* are so fixed to the vanes 3 as to short-circuit every other vane 3. In other words, the inner strap ring 5*a* on the upper ends of the vanes 3 and the outer strap ring 5*b* on the lower ends of the vanes 3 are fixed to the same alternately-arranged vanes 3, while the outer strap ring 5*b* on the upper ends of the vanes 3 and the inner strap ring 5*a* on the lower ends are fixed to the remaining vanes 3 respectively. The respective adjacent vanes 3 and the inner wall of the anode cylinder 4 define spaces 6 partially opened toward the cathode 2 to form cavity resonators, thereby to determine the oscillation frequency of the magnetron 1 by the resonance frequency of the cavity resonators. A space 7 defined between the vanes 3 and the cathode 2 is called an interaction space. An uniform direct-current magnetic field is applied to the interaction space 7 in parallel with the central axis of the cathode 2. To this end, permanent magnets 8 are arranged in the vicinity of the upper and lower ends of the anode cylinder 4 respectively. Direct-current or low-frequency high voltage is applied between the cathode 2 and the vanes 3.

In the aforementioned structure, high-frequency electric fields formed in the cavity resonators are concentrated to the forward end portions of the respective vanes 3, and partially leak into the interaction space 7. The inner and outer strap rings 5*a* and 5*b* couple alternate ones of the vanes 3, and hence the respective adjacent vanes 3 are at reverse potentials in high frequency. Therefore, an electron group emitted from the cathode 2 rotates about the cathode 2 in the interaction space 7, whereby interaction takes place between the electron group and the high-frequency electric field, to cause oscillation of microwaves. The microwaves obtained by this oscillation are outwardly guided through an antenna 10 which is connected to one vane 3. Since conversion efficiency to microwave power is not 100%, the energy of the electron group is partially consumed as heat. Therefore, fins 11 are provided along the outer circumference of the anode cylinder 4 for radiating the heat. It is to be noted that FIG. 1B shows only the internal structure of the anode cylinder 4 and the fins 11 etc. are not shown therein.

International standards are established by ITU (International Telecommunication Union) for the above described magnetron, whereby the basic frequency of 2450 MHz is allocated to food heating apparatus, medical appliances, parts of industrial instruments and the like. In such application, therefore, the magnetron 1 ideally oscillates only microwaves at the basic frequency of 2450 MHz, whereas the same generates various higher harmonics in practice. Within such higher harmonics, the fifth higher harmonic having a frequency of 12.25 GHz overlaps with the frequency range employed for satellite broadcasting recently under practice, to cause serious problems.

SUMMARY OF THE INVENTION

Accordingly, it is an object of the present invention to provide a magnetron which can suppress undesired higher harmonics of the basic frequency of microwave oscillation.

Briefly stated, strap ring means for electrically coupling alternate vanes are arranged in positions separated from the radially innermost ends of the vanes by a distance in excess of a prescribed interval, thereby to suppress generation of undesired higher harmonics.

According to the present invention, generation of undesired higher harmonics of the basic frequency can be efficiently suppressed by partially modifying the structure of a conventional magnetron in a simple manner without adding any new component.

These and other objects, features, aspects and advantages of the present invention will become more apparent from the following detailed description of the present invention when taken in conjunction with the accompanying drawings.

DESCRIPTION OF THE PREFERRED EMBODIMENT

The inventors have found that the locations of the strap rings significantly affect the levels of harmonics of the basic frequency of microwaves generated by a magnetron. For example, the inner strap rings are at potentials identical to those of the vanes to which the same are coupled. Such strap rings are generally arranged in positions close to the radially innermost end portions of the vanes, to exert bad influence on the high-frequency electric fields around the vanes to which the straps are not coupled, these vanes being at reverse potentials thereto. Therefore, the present invention is directed to reducing the said bad influence by separating the strap rings by a prescribed interval from the radially innermost portions of the vanes, thereby to suppress generation of higher harmonics of the basic frequency.

Figure 1A:
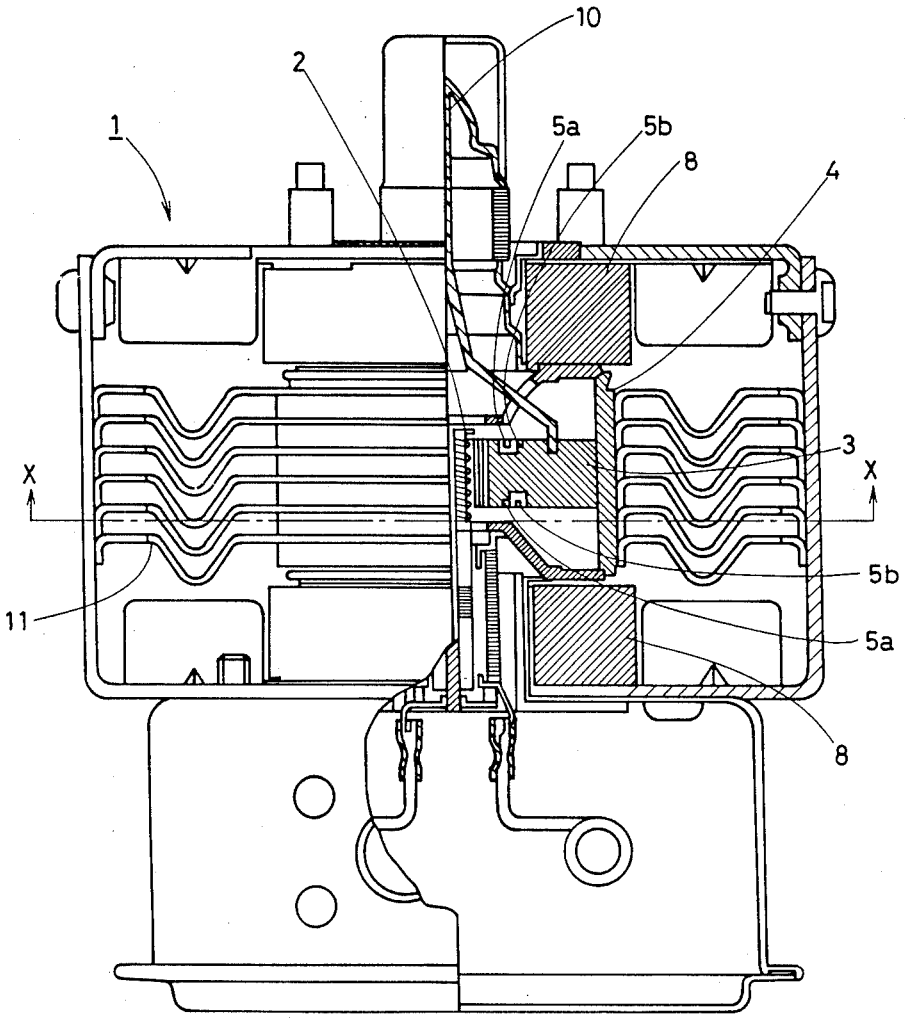
FIG. 1A PRIOR ART
FIG. 1A is a partially fragmented front elevational view showing structure of a conventional magnetron.
Figure 2:
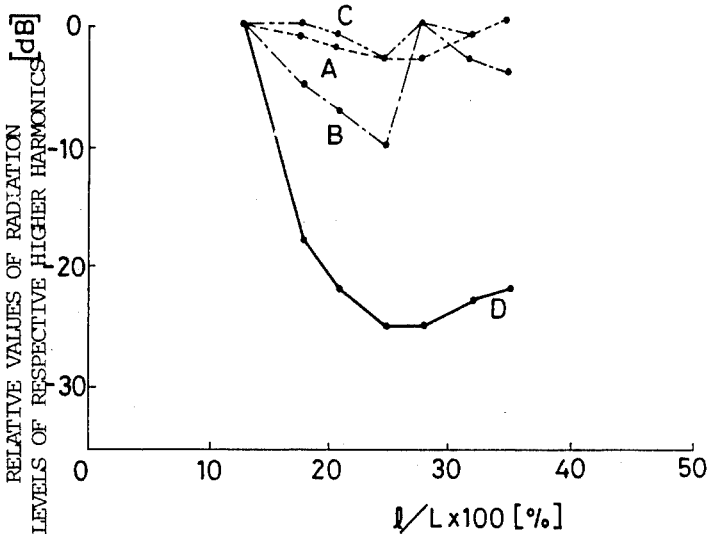
FIG. 2 is a characteristic diagram showing radiation levels of various higher harmonics in an embodiment of the present invention.
Figure 1B:
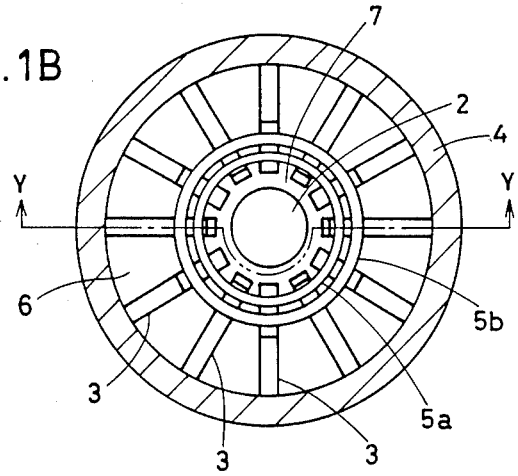
FIG. 1B is a sectional view taken along the line X—X in FIG. 1A.
Figure 1C:
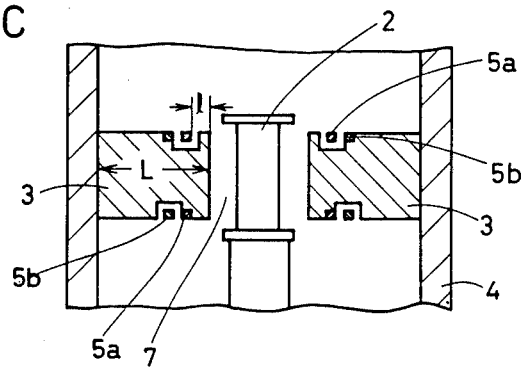
FIG. 1C is a sectional view taken along the line Y—Y in FIG. 1B.

FIG. 2 is a graph showing radiation levels of second to fifth higher harmonics in case of changing positions of the inner and outer strap rings 5a and 5b of the magnetron 1 as shown in FIGS. 1A to 1C. Referring to FIG. 2, the horizontal axis indicates the distance ratio $(l/L)\times 100$ (%) where 1 is the distance from the radially innermost end portions of the vanes 3 to the radially innermost surfaces (i.e., surfaces opposite, and L is the cathode 2) of the inner strap rings 5a to the full length of the vanes 3. The vertical axis indicates relative values on the basis of radiation levels of respective higher harmonics in case where the said distance ratio is 13% in the prior art example. Characteristic curves A, B, C and D represent second, third, fourth and fifth higher harmonics respectively. In this embodiment, intervals between the inner strap rings 5a and the outer strap rings 5b are always constant.

As obvious from FIG. 2, the radiation levels of the respective higher harmonics are lowered in comparison with the conventional case as the positions of the inner strap rings 5a approach the outer end portions of the vanes 3, and that of the fifth higher harmonic is extremely lowered in particular.

Thus, generation of the higher harmonics of the basic frequency can be suppressed in comparison with the conventional case by arranging the inner strap rings 5a so that their radial distance 1 from the radially innermost portions of the vanes 3 exceeds 13 % of the full radial extent L of the vanes 3. Preferably, the ratio l/L is within the range of 18 to 35%, and the optimum range is within 21 to 28%.

Although the above embodiment has been described with respect to a magnetron having basic frequency of 2450 MHz, the present invention is not restricted to the same and is applicable to a magnetron whose basic frequency is selected to be within a range of, e.g., 2400 to 2500 MHz, or further to that having basic frequency beyond the said range.

Further, although the embodiment has been described on the case of suppressing the fifth higher harmonic in particular within various higher harmonics, generation of other higher harmonics can also be suppressed by properly selecting the positions of the strap rings, as obvious from the graph shown in FIG. 2.

Although, in addition, respective two strap rings are provided on the upper and lower ends of the vanes 3, the present invention is not restricted to such a mode. For example, one or more strap rings may be provided only on the upper or lower ends of the vanes 3, or an inner strap ring may be provided on either the upper ends or the lower ends of the vanes 3 while providing an outer strap ring on the other ends. Further, the strap rings may pass through the respective vanes.

It is to be noted that FIGS. 1A to 1C merely illustrate an example of the conventional magnetron, and the present invention can be applied to other types of magnetrons including some modifications.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A magnetron which comprises:

an anode cylinder ;

a plurality of panel-shaped substantially identical vanes radially arranged in the inner wall of said anode cylinder, said vanes having radially innermost edges in mutually spaced relationship;

strap ring means generally concentric with said anode cylinder for electrically coupling said vanes in an alternate manner;

a cathode disposed within said anode cylinder in spaced relationship to said radially innermost edges, to define an interaction space between said cathode and said innermost edges of said vanes; and means for providing magnetic fields along the axial direction of said anode cylinder and within said an interaction space, said magnetron generating microwaves at a predetermined basic frequency while inevitably generating higher harmonics accompanying said basic frequency, said strap ring means having an inside diameter selected so that the ratio l/L exceeds a predefined minimum calculated to produce high degree of suppression of the fifth harmonic of said basic frequency, where 1 is the distance by which the radially innermost edge of said strap ring means is radially outward of said vane innermost edges and L is the radial extent of said vanes , said strap ring means suppressing the generation of undesired higher harmonics including said fifth harmonic.

2. A magnetron in accordance with claim 1, wherein the ratio l/L exceeds 13 percent.

3. A magnetron in accordance with claim 1, wherein the ratio l/L is within the range of 18 to 35 percent.

4. A magnetron in accordance with claim 1, wherein the ratio l/L is within the range of 21 to 28 percent.

5. A magnetron in accordance with claim 1, wherein said basic frequency is selected to be within a range of 2400 to 2500 MHz.

6. A magnetron in accordance with claim 5, wherein said basic frequency is selected to be at 2450 MHz.

7. A magnetron in accordance with claim 1, wherein said strap ring means comprises a plurality of strap rings , a strap of said strap ring means closest to said cathode being arranged in a position separated from said innermost edges of said vanes to exceed said l/L ratio.

8. A magnetron in accordance with claim 7, wherein the ratio l/L exceeds 13 percent.

9. A magnetron in accordance with claim 8, wherein the ratio l/L is within the range of 18 to 35 percent.

10. A magnetron in accordance with claim 8, wherein the ratio l/L is within the range of 21 to 28 percent.

11. A magnetron in accordance with claim 7, wherein said basic frequency is selected to be within a range of 2400 to 2500 MHz.

12. A magnetron in accordance with claim 11, wherein said basic frequency is selected to be at 2450 MHz.

* * * * *